US011670209B2

(12) United States Patent
Lee et al.

(10) Patent No.: US 11,670,209 B2
(45) Date of Patent: Jun. 6, 2023

(54) DISPLAY DEVICE PERFORMING CLOCK GATING

(71) Applicant: SAMSUNG DISPLAY CO., LTD., Yongin-si (KR)

(72) Inventors: Hyo-Chul Lee, Yongin-si (KR); Min Joo Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/656,913

(22) Filed: Mar. 29, 2022

(65) Prior Publication Data

US 2023/0023898 A1 Jan. 26, 2023

(30) Foreign Application Priority Data

Jul. 26, 2021 (KR) ..... 10-2021-0098125

(51) Int. Cl.
*G09G 3/20* (2006.01)

(52) U.S. Cl.
CPC ..... *G09G 3/20* (2013.01); *G09G 2310/027* (2013.01); *G09G 2310/061* (2013.01); *G09G 2310/08* (2013.01); *G09G 2330/021* (2013.01)

(58) Field of Classification Search
CPC ..... G09G 3/20; G09G 2310/0286; G09G 2310/027; G09G 2310/061; G09G 2310/08; G09G 2320/0219; G09G 2330/021
See application file for complete search history.

(56) References Cited

U.S. PATENT DOCUMENTS

| | | | | |
|---|---|---|---|---|
| 2014/0198114 | A1 | 7/2014 | Nambi et al. | |
| 2015/0029233 | A1 | 1/2015 | Bae et al. | |
| 2017/0287420 | A1* | 10/2017 | Noguchi | G09G 3/3688 |
| 2019/0122630 | A1* | 4/2019 | Kwon | G02F 1/133514 |
| 2020/0074957 | A1 | 3/2020 | Amirkhany et al. | |

FOREIGN PATENT DOCUMENTS

| | | |
|---|---|---|
| KR | 10-0948057 | 3/2010 |
| KR | 10-2013-0033174 | 4/2013 |
| KR | 10-1252090 | 4/2013 |
| KR | 10-2019-0079284 | 7/2019 |

OTHER PUBLICATIONS

Extended European Search Report dated Nov. 29, 2022 in corresponding European Patent Application No. 22186790.6 (17 pages).

* cited by examiner

*Primary Examiner* — Gerald Johnson
(74) *Attorney, Agent, or Firm* — F. Chau & Associates, LLC

(57) ABSTRACT

A display device includes a display panel including a plurality of pixels, a controller configured to output image data and a gated clock signal, the image data including a plurality of pixel data for the plurality of pixels, and a data driver configured to receive the image data and the gated clock signal from the controller, and to sample the image data in response to the gated clock signal. The controller detects a repeated data pattern where same pixel data is repeated in the image data, generates a clock enable signal having an off level in a period in which the repeated data pattern is transferred, and gates an input clock signal in response to the clock enable signal to produce the gated clock signal.

20 Claims, 11 Drawing Sheets

DISPLAY DEVICE PERFORMING CLOCK GATING

CROSS-REFERENCE TO RELATED APPLICATION

This application claims priority under 35 USC § 119 to Korean Patent Application No. 10-2021-0098125, filed on Jul. 26, 2021 in the Korean Intellectual Property Office (KIPO), the content of which is incorporated by reference herein in its entirety.

TECHNICAL FIELD

Embodiments of the present inventive concept relate to a display device, and more particularly to a display device performing a clock gating operation.

DISCUSSION OF THE RELATED ART

Recently, display devices have seen increased use in consumer electronics. For example, display devices are applied to various electronic appliances such as smart phones, smart watches, digital cameras, notebook computers, navigators, and smart televisions. As display devices become more capable, newer devices are produced with increased image quality, data transfer speeds, and processing power.

As the resolution, driving frequency, etc. of the display devices increases, a data transfer speed between internal components of the display device may be increased, and power consumption for data transfer may be increased. In a mobile device, such as a smart phone, a tablet computer, for example, the increased data transfer speeds may cause increased power and battery usage.

SUMMARY

Some embodiments of the present disclosure provide a display device capable of reducing power consumption for data transfer in a display device.

A display device according to embodiments of the present disclosure includes a display panel including a plurality of pixels, a controller configured to output image data and a gated clock signal, the image data including a plurality of pixel data for the plurality of pixels, and a data driver configured to receive the image data and the gated clock signal from the controller, and to sample the image data in response to the gated clock signal. The controller detects a repeated data pattern where same pixel data is repeated in the image data generates a clock enable signal having an off level during a power saving period in which the repeated data pattern is transferred, and gates an input clock signal in response to the clock enable signal to produce the gated clock signal.

In embodiments, the data driver may not sample the image data in the power saving period in which the repeated data pattern is transferred.

In embodiments, the gated clock signal may have a constant level during the power saving period in which the repeated data pattern is transferred and during a horizontal blank period.

In embodiments, the data driver may sample the image data during periods when the gated clock signal periodically toggles, and may not sample the image data in response during periods when gated clock signal has the constant level.

In embodiments, the controller may include a pattern detector configured to detect the repeated data pattern in the image data, a clock enable signal generator configured to generate the clock enable signal having the off level during the power saving period in which the repeated data pattern is transferred and during a horizontal blank period, and a clock gating circuit configured to gate the input clock signal in response to the clock enable signal to produce the gated clock signal.

In embodiments, the data driver may include a sampling circuit configured not to sample the image data in response to the gated clock signal having a constant level during the power saving period in which the repeated data pattern is transferred and during a horizontal blank period, and to sample the image data in response to the gated clock signal periodically toggling between a high value and a low value during other periods.

In embodiments, the display device may further include a clock signal line through which the gated clock signal is transferred from the controller to the data driver, and a plurality of data transfer lines through which the image data is transferred from the controller to the data driver.

In embodiments, a plurality of bits of each pixel data of the image data may be substantially simultaneously transferred through the plurality of data transfer lines.

In embodiments, each of the plurality of data transfer lines may have constant levels corresponding to the same pixel data in the power saving period in which the repeated data pattern is transferred.

In embodiments, when the same pixel data is repeated more than a predetermined number of times in the image data, the controller may detect the same pixel data repeated more than the predetermined number of times as the repeated data pattern.

A display device according to embodiments of the present disclosure includes a display panel including a plurality of pixels, a data driver configured to provide data signals to the plurality of pixels, a scan driver configured to provide scan signals to the plurality of pixels, and a controller configured to control the data driver and the scan driver. The controller includes a transmitting block configured to output image data and a gated clock signal, the image data including a plurality of pixel data for the plurality of pixels, and a receiving block configured to receive the image data and the gated clock signal from the transmitting block, and to sample the image data in response to the gated clock signal. The transmitting block detects a repeated data pattern where same pixel data is repeated in the image data, generates a clock enable signal having an off level during a power saving period in which the repeated data pattern is transferred, and gates an input clock signal in response to the clock enable signal to produce the gated clock signal.

In embodiments, the gated clock signal may have a constant level during the power saving period in which the repeated data pattern is transferred and during a horizontal blank period, and may periodically toggle between a high value and a low value during other periods.

In embodiments, the receiving block may sample the image data in response to when the gated clock signal periodically toggles, and may not sample the image data in response to when the gated clock signal has the constant level.

In embodiments, the transmitting block may include a pattern detector configured to detect the repeated data pattern in the image data, a clock enable signal generator configured to generate the clock enable signal with the off level during the power saving period in which the repeated data pattern is transferred and during a horizontal blank period, and a clock gating circuit configured to gate the input clock signal in response to the clock enable signal to produce the gated clock signal.

In embodiments, the controller may further include a clock signal line through which the gated clock signal is transferred from the transmitting block to the receiving block, and a plurality of data transfer lines through which the image data is transferred from the transmitting block to the receiving block.

In embodiments, a plurality of bits of each pixel data of the image data may be substantially simultaneously transferred through the plurality of data transfer lines.

In embodiments, the plurality of data transfer lines may have constant levels corresponding to the same pixel data in the power saving period in which the repeated data pattern is transferred.

A display device according to embodiments of the present disclosure includes a display panel including a plurality of pixels, and a panel driver configured to drive the display panel. The panel driver includes a transmitting unit configured to output image data and a gated clock signal, the image data including a plurality of pixel data for the plurality of pixels, and a receiving unit configured to receive the image data and the gated clock signal from the transmitting unit, and to sample the image data in response to the gated clock signal. The transmitting unit detects a repeated data pattern where same pixel data is repeated in the image data, generates a clock enable signal having an off level during a power saving period in which the repeated data pattern is transferred, and gates an input clock signal in response to the clock enable signal to produce the gated clock signal.

In embodiments, the panel driver may include a data driver, a scan driver and a controller, the transmitting unit may include the controller, and the receiving unit may include the data driver.

In embodiments, the panel driver may include a data driver, a scan driver and a controller, the transmitting unit may include a transmitting block included in the controller, and the receiving unit may include a receiving block included in the controller.

As described above, in a display device according to embodiments, a transmitting unit (e.g., a controller or a transmitting block of the controller) may detect a repeated data pattern where the same pixel data is repeated in image data, may generate a clock enable signal having an off level in a power saving period in which the repeated data pattern is transferred, and may gate a clock signal in response to the clock enable signal. Further, a receiving unit (e.g., a data driver or a receiving block of the controller) may not sample the image data in the power saving period in which the repeated data pattern is transferred. Accordingly, power consumption of the display device may be reduced.

BRIEF DESCRIPTION OF THE DRAWINGS

The above and other aspects and features of the present disclosure will become more apparent by describing in detail embodiments thereof with reference to the attached drawings.

DETAILED DESCRIPTION OF THE EMBODIMENTS

Figure 1:
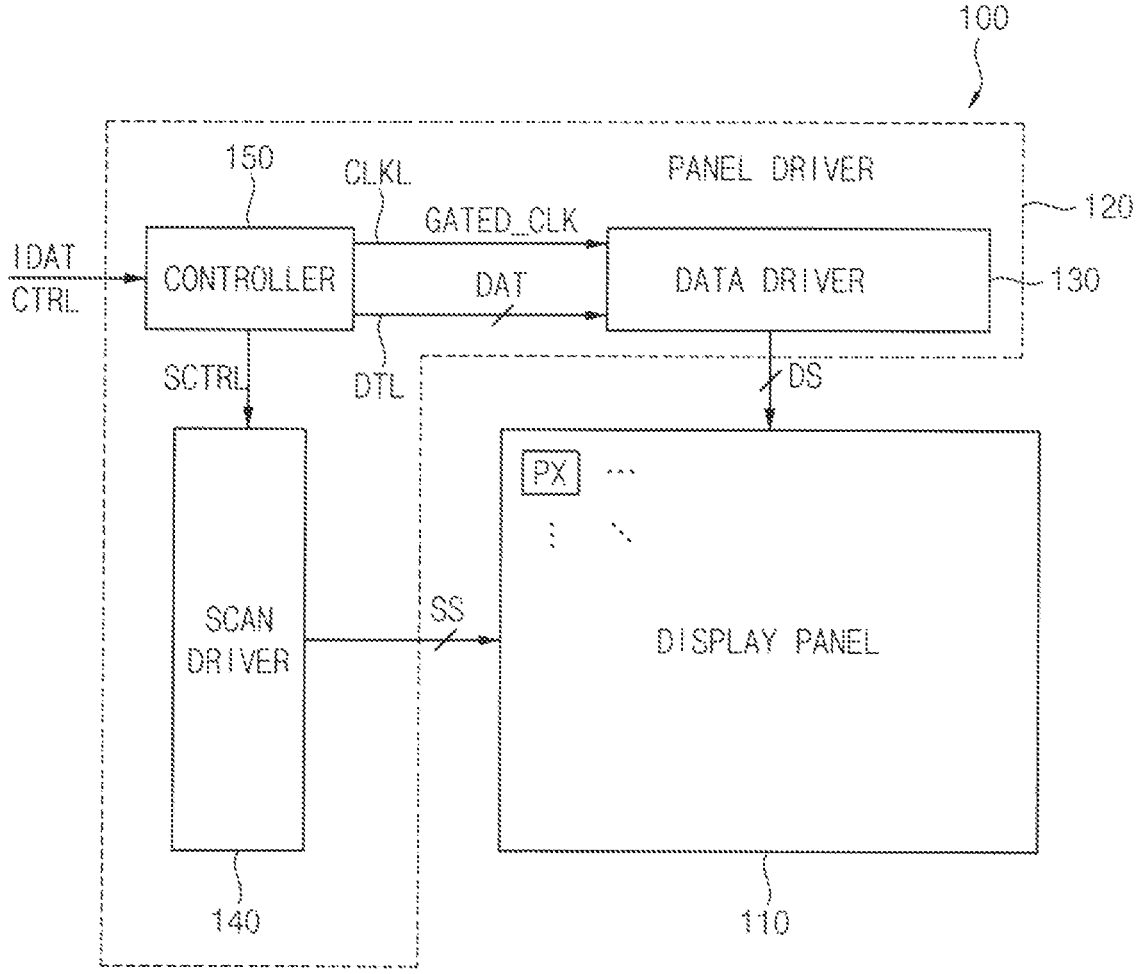
FIG. 1 is a block diagram that illustrates a display device according to embodiments.

Hereinafter, embodiments of the present inventive concept will be explained in detail with reference to the accompanying drawings.

Throughout the specification, like reference symbols in the drawings may denote like elements, and to the extent that a description of an element has been omitted, it may be understood that the element is at least similar to corresponding elements that are described elsewhere in the specification.

Unless otherwise specified or indicated by the context and/or Figures, the use of "may not", e.g., "may not (perform the action)", does not necessarily preclude the possibility of an embodiment that performs the action. For example, if an embodiment "may not" sample image data during a time or condition, it will be appreciated that the disclosure provides for additional embodiments that may or may not sample the image data, along with embodiments that do not sample the image data during the time or condition, in accordance with the teachings and inventive concepts provided herein.

Figure 2:
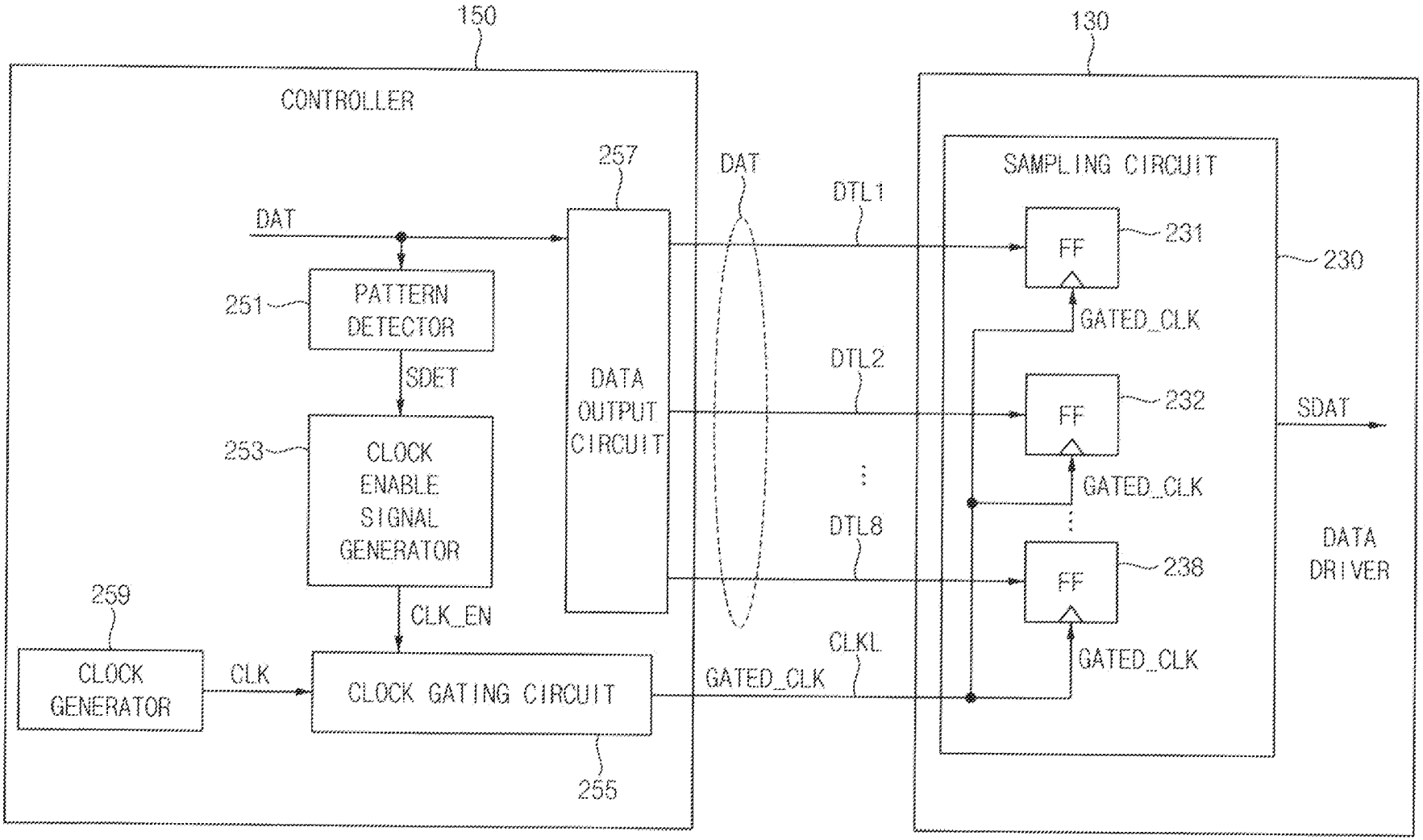
FIG. 2 is a block diagram that illustrates an example of a controller and a data driver included in a display device according to embodiments.
Figure 3:
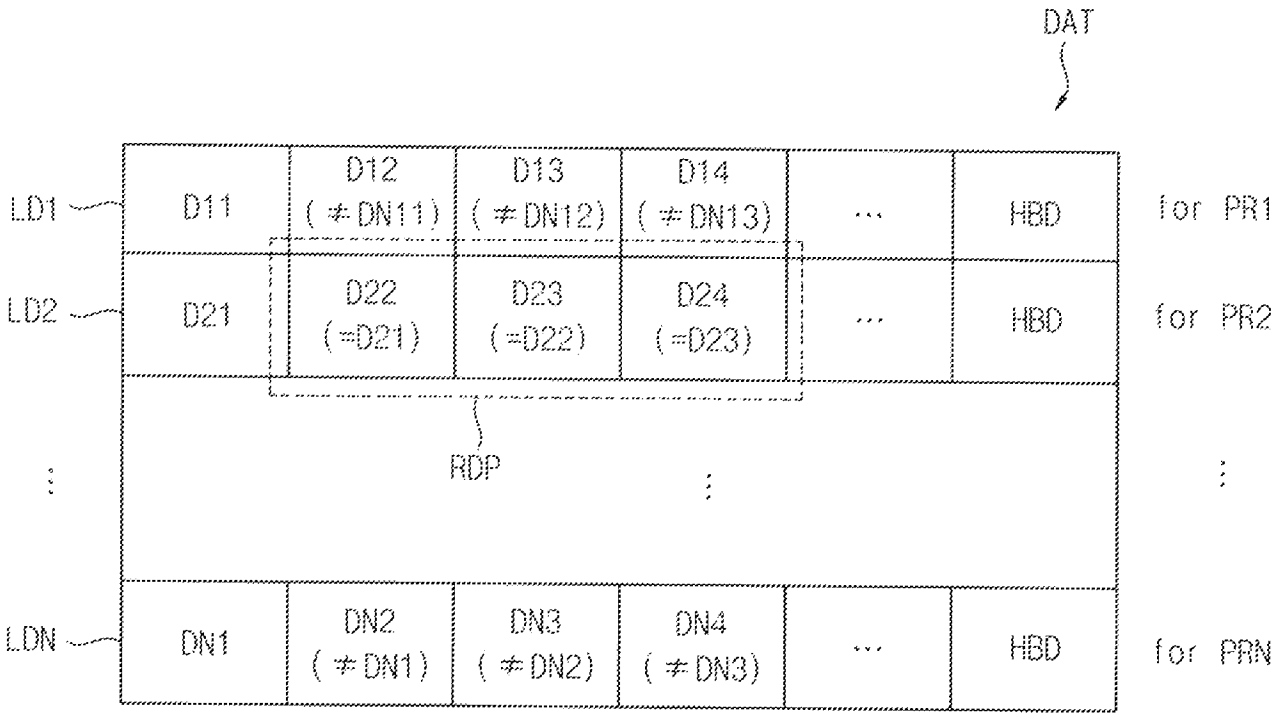
FIG. 3 is a diagram that illustrates an example of image data transferred in a display device according to embodiments.
Figure 4:
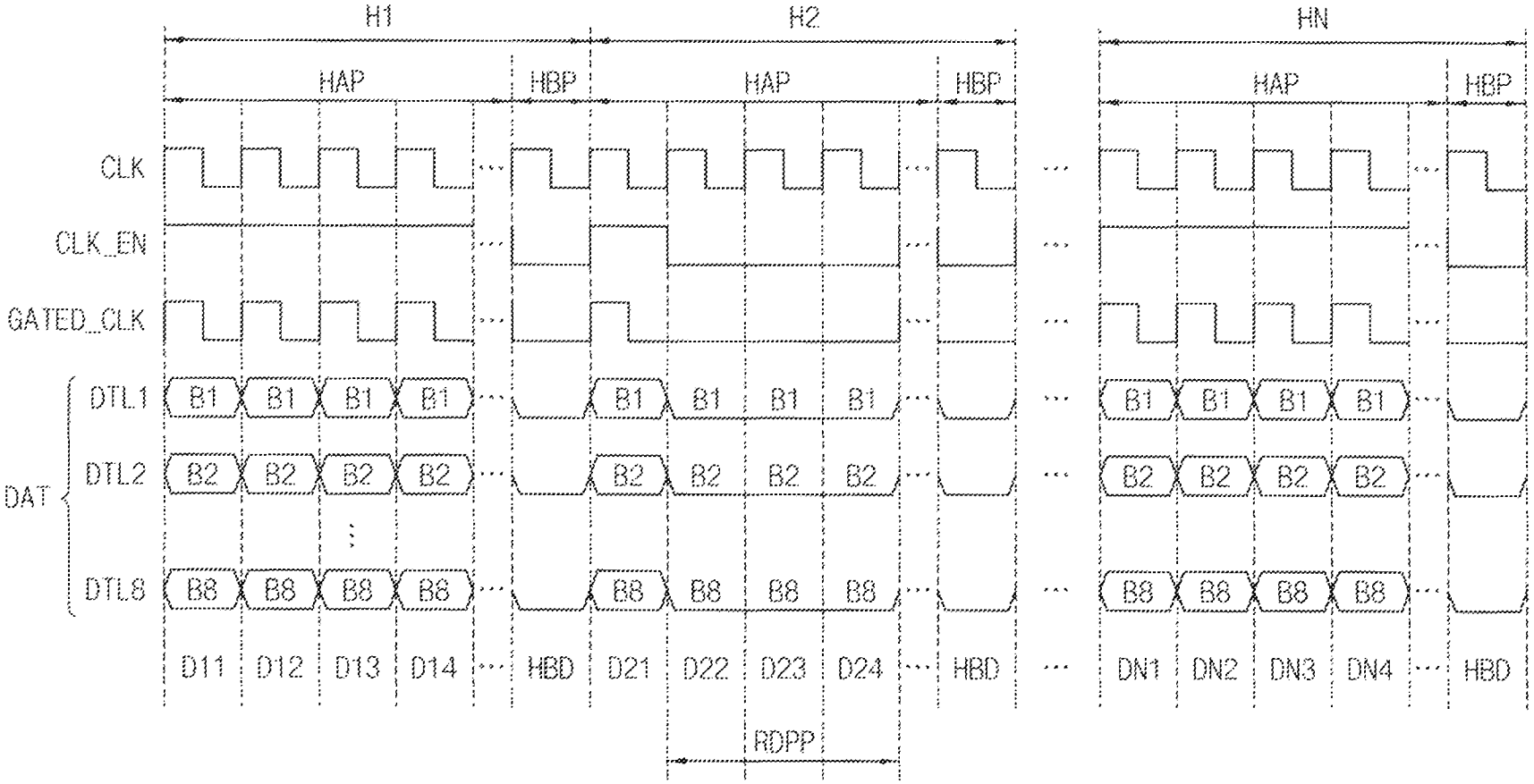
FIG. 4 is a timing diagram that illustrates image data of FIG. 3 transferred in a display device according to embodiments.

FIG. 1 is a block diagram that illustrates a display device according to embodiments, FIG. 2 is a block diagram that illustrates an example of a controller and a data driver included in a display device according to embodiments, FIG. 3 is a diagram that illustrates an example of image data transferred in a display device according to embodiments, and FIG. 4 is a timing diagram that illustrates image data of FIG. 3 transferred in a display device according to embodiments.

Referring to FIG. 1, a display device 100 according to embodiments may include a display panel 110 including a plurality of pixels PX, and a panel driver 120 that drives the display panel 110. In some embodiments, the panel driver 120 may include a data driver 130 that provides data signals DS to the plurality of pixels PX, a scan driver 140 that provides scan signals SS to the plurality of pixels PX, and a controller 150 that controls the data driver 130 and the scan driver 140.

The display panel 110 may include a plurality of data lines, a plurality of scan lines, and the plurality of pixels PX that are coupled to the plurality of data lines and the plurality of scan lines. In some embodiments, each pixel PX may include at least two transistors, at least one capacitor and a light emitting element, and the display panel 110 may be a light emitting display panel. For example, the light emitting element may be, but not limited to, an organic light emitting diode (OLED), a quantum dot (QD) light emitting element, or the like. In other embodiments, the display panel 110 may be a liquid crystal display (LCD) panel, or may be any other suitable display panel. For example, in such embodiments, the pixel PX might not include a light emitting element.

The data driver 130 may receive image data DAT through a plurality of data transfer lines DTL from the controller 150, and may receive a clock signal GATED_CLOCK through a clock signal line CLKL from the controller 150. In some embodiments, the clock signal GATED_CLOCK transferred through the clock signal line CLKL may be gated by the controller 150. The data driver 130 may sample (e.g., reads and captures) the image data DAT in response to the gated clock signal GATED_CLOCK, and may provide the data signals DS to the plurality of pixels PX through the plurality of data lines based on the sampled image data DAT. In some embodiments, the data driver 130 may further receive a data control signal from the controller 150. For example, the data control signal may include, but not limited to, an output data enable signal, a horizontal start signal, a load signal, or the like. In some embodiments, the data driver 130 and the controller 150 may be implemented with a single integrated circuit, and the single integrated circuit may be referred to as a timing controller embedded data driver (TED). In other embodiments, the data driver 130 and the controller 150 may be implemented with separate integrated circuits.

The scan driver 140 may generate the scan signals SS based on a scan control signal SCTRL received from the controller 150, and may sequentially provide the scan signals SS to the plurality of pixels PX on a row-by-row basis through the plurality of scan lines. In some embodiments, the scan control signal SCTRL may include, but not limited to, a scan start signal and a scan clock signal. In some embodiments, the scan driver 140 may be integrated or formed in a peripheral portion of the display panel 110. In some embodiments, the scan driver 140 may be implemented with one or more integrated circuits.

The controller 150 (e.g., a timing controller (TCON)) may receive input image data IDAT and a control signal CTRL from an external host processor (e.g., an application processor (AP), a graphics processing unit (GPU) and/or a graphics card). In some embodiments, the input image data IDAT may include RGB image data including red image data, green image data and blue image data. In some embodiments, the control signal CTRL may include, but not limited to, a vertical synchronization signal, a horizontal synchronization signal, an input data enable signal, a master clock signal, or the like. The controller 150 may generate the image data DAT including a plurality of pixel data for the plurality of pixels PX based on the input image data IDAT, may output the image data DAT to the data driver 130 through the plurality of data transfer lines DTL, and may output the gated clock signal GATED_CLK to the data driver 130 through the clock signal line CLKL. Further, the controller 150 may generate the scan control signal SCTRL based on the control signal CTRL, and may control an operation of the scan driver 140 by providing the scan control signal SCTRL to the scan driver 140.

In the display device 100 according to at least one embodiment of the present disclosure, the controller 150 may detect a repeated data pattern where the same pixel data is repeated in the image data DAT, may generate a clock enable signal having an off level (e.g., a low level) in a power saving period in which the repeated data pattern is transferred, and may gate the clock signal GATED_CLK in response to the clock enable signal. For example, there may be same pixel data in the image data DAT where two or more pixel data have the same value for two or more consecutive pixels PX in one pixel row. As used herein, a first signal is "gated" based on an enable signal to generate a first gated signal. This may be analogous to performing an AND operation between the first signal and the enable signal. For example, when the first signal is gated by an enable signal, the first gated signal may be the original first signal when the enable signal is a constant "on" (e.g., a high) level. When an enable signal is a constant "off" (e.g., low) level, then the first gated signal may also be a constant off (e.g. low) level. In some embodiments, the clock enable signal may have the off level during the power saving period in which the repeated data pattern is transferred within a horizontal active period and during a horizontal blank period. Thus, the clock signal GATED_CLK may be gated based on the clock enable signal, and may not toggle in the power saving period in which the repeated data pattern is transferred and in the horizontal blank period, and may have a constant level (e.g., a low level). In the power saving period in which the repeated data pattern is transferred and the horizontal blank period, or in a period in which the gated clock signal GATED_CLK does not toggle and has the constant level, the data driver 130 may not sample the image data DAT.

To perform these operations, as illustrated in FIG. 2, the controller 150 may include a pattern detector 251, a clock enable signal generator 253 and a clock gating circuit 255, and the data driver 130 may include a sampling circuit 230. In some embodiments, the controller 150 may further include a data output circuit 257 and/or a clock generator 259.

The pattern detector 251 may detect the repeated data pattern in the image data DAT, and may generate a detection signal SDET representing the repeated data pattern. The detection signal SDET may be, for example, a binary signal indicating the presence of the repeated data pattern, or may be, for example, a signal carrying information about the repeated pixel data. Here, the repeated data pattern may mean two or more pixel data having the same value for two or more consecutive pixels PX in one pixel row. In some embodiments, the pattern detector 251 may detect when the same pixel data repeated more than a predetermined number of times, and may determine this same pixel data as the repeated data pattern. In some embodiments, the pattern detector 251 may determine that the same pixel data repeated less than the predetermined number of times are not the repeated data pattern. For example, the predetermined number may be, but not limited to, about fifty. For example, in some embodiments, pixel data may have to repeat about fifty or more times (e.g., consecutively in a pixel row) to qualify as a repeated data pattern. In some embodiments, the pattern detector 251 may read the pixel data in advance by the predetermined number of pixels to make a determination of the repeated data pattern before the sampling is enabled or disabled by the clock enable signal generator 253 and clock gating circuit 255.

The clock enable signal generator 253 may receive the detection signal SDET representing the repeated data pattern from the pattern detector 251, and may generate the clock enable signal CLK_EN having the off level in the power saving period in which the repeated data pattern is transferred within the horizontal active period in response to the detection signal SDET. Further, in some embodiments, the clock enable signal generator 253 may control the clock enable signal CLK_EN to be set in the off level in the horizontal blank period.

The clock gating circuit 255 may receive a clock signal CLK from the external host processor, or may receive a clock signal CLK from the clock generator 259. The clock signal CLK may periodically toggle between a high level and a low level. The clock gating circuit 255 may further receive the clock enable signal CLK_EN from the clock enable signal generator 253. The clock gating circuit 255 may generate the gated clock signal GATED_CLK by gating the clock signal CLK in response to the clock enable signal CLK_EN. In some embodiments, the clock enable signal CLK_EN may have an on level (e.g., a high level) in the horizontal active period, except for the power saving period in which the repeated data pattern is transferred, and may have the off level (e.g., a low level) in the power saving period in which the repeated data pattern is transferred and in the horizontal blank period. In the horizontal active period except for the power saving period in which the repeated data pattern is transferred, the clock gating circuit 255 may output the clock signal CLK (received from, e.g., the clock generator 259) as the gated clock signal GATED_CLK when the clock enable signal CLK_EN has the on level, and thus the gated clock signal GATED_CLK may periodically toggle. In the power saving period in which the repeated data pattern is transferred and in the horizontal blank period, the clock gating circuit 255 may not output the clock signal CLK as the gated clock signal GATED_CLK when the clock enable signal CLK_EN has the off level, and thus the gated clock signal GATED_CLK may have a constant level (e.g., a low level) during the power saving period in which the repeated data pattern is transferred.

The data output circuit 257 may transfer the image data DAT to the sampling circuit 230 of the data driver 130 through the plurality of data transfer lines DTL1, DTL2, . . . , DTL8. In some embodiments, a plurality of bits of each pixel data of the image data DAT may be substantially simultaneously transferred through the plurality of data transfer lines DTL1 through DTL8. For example, each pixel data of the image data DAT may have eight bits, and the eight bits of each pixel data may be respectively transferred through eight data transfer lines DTL1 through DTL8 during one cycle of the gated clock signal GATED_CLK. Although FIG. 2 illustrates an example where eight data transfer lines DTL1 through DTL8 are disposed between the controller 150 and the data driver 130, the number of the data transfer lines DTL1 through DTL8 is not limited to eight. For example, sixteen data transfer lines, twenty four data transfer lines, thirty two data transfer lines, etc. may be disposed between the controller 150 and the data driver 130. Further, the clock gating circuit 255 may transfer the gated clock signal GATED_CLK to the sampling circuit 230 of the data driver 130 through the clock signal line CLKL.

The sampling circuit 230 may receive the image data DAT through the plurality of data transfer lines DTL1 through DTL8, and may receive the gated clock signal GATED_CLK through the clock signal line CLKL. The sampling circuit 230 may generate sampled image data SDAT by sampling the image data DAT in response to the gated clock signal GATED_CLK. For example, in some embodiments, as illustrated in FIG. 2, the sampling circuit 230 may include a plurality of flip-flops (FFs) 231, 232, . . . , 238 that samples or captures the image data DAT at an edge (e.g., a falling edge or a rising edge) of the gated clock signal GATED_CLK. In some embodiments, the sampling circuit 230 may sample the image data DAT in response to the gated clock signal GATED_CLK, which periodically toggles in the horizontal active period except for the period in which the repeated data pattern is transferred, and may not sample the image data DAT when the gated clock signal GATED_CLK has the constant level (e.g., the low level) in the power saving period in which the repeated data pattern is transferred and in the horizontal blank period. Accordingly, since the sampling circuit 230 does not sample the image data DAT in the power saving period in which the repeated data pattern is transferred and in the horizontal blank period, power consumption of the data driver 130 and the display device 100 may be reduced.

FIG. 3 illustrates an example of the image data DAT, and FIG. 4 illustrates an example where the image data DAT of FIG. 3 is transferred. For example, the display panel 110 may include N pixel rows PR1, PR2, . . . , PRN, and the image data DAT may include N line data LD1, LD2, . . . , LDN for corresponding N pixel rows PR1, PR2, . . . , PRN as illustrated in FIG. 3, where N is an integer greater than 1. First line data LD1 may include pixel data D11, D12, D13, D14, . . . for the pixels PX in a first pixel row PR1 and horizontal blank data HBD, second line data LD2 may include pixel data D21, D22, D23, D24, . . . for the pixels PX in a second pixel row PR2 and the horizontal blank data HBD, and N-th line data LD1 may include pixel data DN1, DN2, DN3, DN4, . . . for the pixels PX in an N-th pixel row PRN and the horizontal blank data HBD. The N line data LD1 through LDN may be sequentially transferred between the controller 150 and the data driver 130.

In a case where the first line data LD1 does not have the same pixel data, or in a case where second pixel data D12 of the first line data LD1 is different from first pixel data D11 of the first line data LD1, and where third pixel data D13 of the first line data LD1 is different from the second pixel data D12 of the first line data LD1, and where fourth pixel data D14 of the first line data LD1 is different from the third pixel data D14 of the first line data LD1, the pattern detector 251 may determine that a repeated data pattern RDP does not exist in the first line data LD1. In this case, as illustrated in FIG. 4, during the horizontal active period HAP of a first horizontal time H1 in which the first line data LD1 is transferred, the clock enable signal generator 253 may generate the clock enable signal CLK_EN with the on (e.g., a high) level, and the clock gating circuit 255 may output the gated clock signal GATED_CLK that periodically toggles (e.g., corresponding to the CLK signal). The plurality of flip-flops 231 through 238 of the sampling circuit 230 may respectively sample a plurality of bits B1, B2, . . . , B8 B8 of the first pixel data D11 of the first line data LD1 in a first cycle of the gated clock signal GATED_CLK, may respectively sample a plurality of bits B1 through B8 of the second pixel data D12 of the first line data LD1 in a second cycle of the gated clock signal GATED_CLK, may respectively sample a plurality of bits B1 through B8 of the third pixel data D13 of the first line data LD1 in a third cycle of the gated clock signal GATED_CLK, and may respectively sample a plurality of bits B1 through B8 of the fourth pixel data D14 of the first line data LD1 in a fourth cycle of the gated clock signal GATED_CLK. During the horizontal blank period HBP of the first horizontal time H1, the clock enable signal generator 253 may generate the clock enable signal CLK_EN with the off (e.g., the low) level, the clock gating circuit 255 may output the gated clock signal GATED_CLK having a low level (e.g., a non-toggling, constant signal), and the sampling circuit 230 may not sample the horizontal blank data HBD. During the horizontal blank period HBP, since the gated clock signal GATED_CLK does not toggle, and the sampling circuit 230 does not perform a sampling operation, the power consumption of the display device 100 may be reduced.

In a case where the second line data LD2 has the same or repeating pixel data, where the second, third and fourth pixel data D22, D23 and D24 of the second line data LD2 are the same as first pixel data D21 of the second line data LD2, the pattern detector 251 may detect the second, third and fourth pixel data D22, D23 and D24 of the second line data LD2 as the repeated data pattern RDP. In this case, as illustrated in FIG. 4, during the horizontal active period HAP of a second horizontal time H2 in which the second line data LD2 is transferred, the clock enable signal generator 253 may generate the clock enable signal CLK_EN with the on level in a first cycle of the clock signal CLK, and may generate the clock enable signal CLK_EN with the off level in the period RDPP in which the repeated data pattern RDP is transferred, e.g., during the second, third and fourth cycles of the clock signal CLK. The clock gating circuit 255 may output the gated clock signal GATED_CLK that toggles in the first cycle of the clock signal CLK, and may output the gated clock signal GATED_CLK having the constant level (e.g., the low level) in the period RDPP in which the repeated data pattern RDP is transferred; in this example, during the second, third and fourth cycles of the clock signal CLK. The plurality of flip-flops 231 through 238 of the sampling circuit 230 may respectively sample a plurality of bits B1 through B8 of the first pixel data D21 of the second line data LD2 in a first cycle of the gated clock signal GATED_CLK. In the period RDPP in which the repeated data pattern RDP is transferred, the plurality of data transfer lines DTL1 through DTL8 may have constant levels corresponding to the same pixel data, and the sampling circuit 230 may not sample the second, third and fourth pixel data D22, D23 and D24 of the second line data LD2. During the period RDPP in which the repeated data pattern RDP is transferred, the gated clock signal GATED_CLK may not toggle, the sampling circuit 230 may not perform the sampling operation, and thus the power consumption of the display device 100 may be further reduced. Although FIG. 4 illustrates an example where the plurality of data transfer lines DTL1 through DTL8 has a low level in the period RDPP in which the repeated data pattern RDP is transferred, the constant levels of the plurality of data transfer lines DTL1 through DTL8 may be, for example, determined depending on the same pixel data. For example, in an embodiment, the levels of the plurality of data transfer lines DTL1 through DTL8 may represent the pixel data. Further, during the horizontal blank period HBP of the second horizontal time H2, the clock gating circuit 255 may output the gated clock signal GATED_CLK with the low level, and the sampling circuit 230 may not sample the horizontal blank data HBD, and the power consumption of the display device 100 may be further reduced.

Further, in a case where the N-th line data LDN does not have the same pixel data, the pattern detector 251 may determine that the repeated data pattern RDP does not exist in the N-th line data LDN. In this case, as illustrated in FIG. 4, during the horizontal active period HAP of an N-th horizontal time HN in which the N-th line data LDN is transferred, the gated clock signal GATED_CLK may periodically toggle, and the sampling circuit 230 may sample pixel data DN1, DN2, DN3, DN4, . . . of the N-th line data LDN. During the horizontal blank period HBP of the N-th horizontal time HN, the gated clock signal GATED_CLK may have the low level, and the sampling circuit 230 may not sample the horizontal blank data HBD.

As described above, in the display device 100 according to embodiments, the controller 150 may detect the repeated data pattern RDP where the same pixel data is repeated in the image data DAT (for example, repeated for a predetermined number of pixels), may generate the clock enable signal CLK_EN with the off level in the period RDPP in which the repeated data pattern RDP is transferred, and may generated the gated clock signal GATED_CLK by gating the clock signal CLK in response to the clock enable signal CLK_EN. Further, the data driver 130 may not sample the image data DAT in the period RDPP in which the repeated data pattern RDP is transferred. Accordingly, the power consumption of the display device 100 may be reduced.

Figure 5:
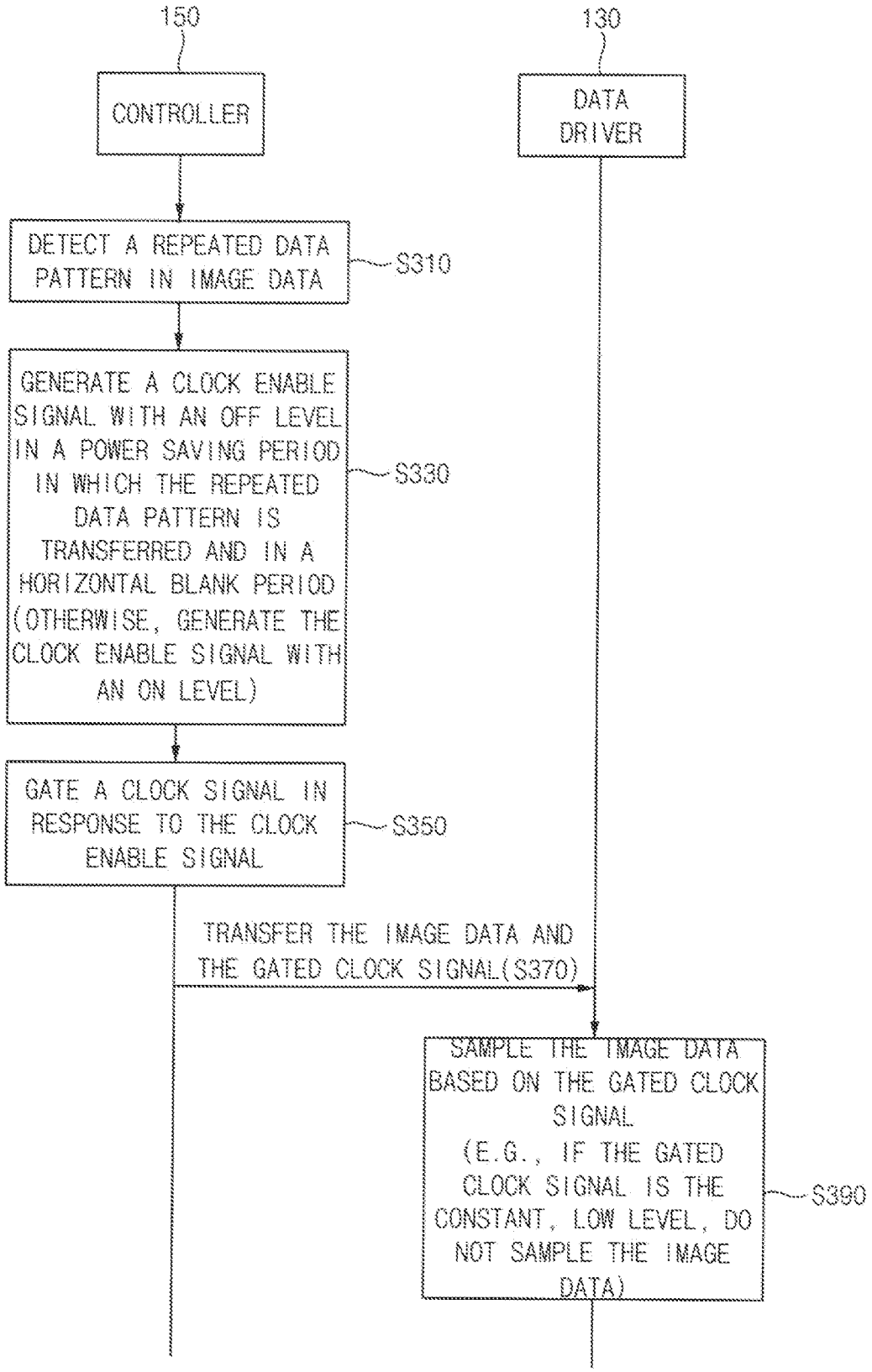
FIG. 5 is a flow chart that illustrates a method of transferring data between a controller and a data driver according to embodiments.

FIG. 5 is a flow chart that illustrates a method of transferring data between a controller and a data driver according to embodiments.

Referring to FIG. 5, a controller 150 may detect a repeated data pattern where the same pixel data is repeated in image data (S310), may generate a clock enable signal in a period (e.g., having an off level) in which the repeated data pattern is transferred and in a horizontal blank period (or may generate a clock enable signal with an on level if the repeated data pattern is not detected) (S330), may generate a gated clock signal by gating a clock signal in response to the clock enable signal (S350), and may transfer the image data and the gated clock signal to a data driver 130 (S370).

The data driver 130 may sample the image data in response to the gated clock signal (S390). The gated clock signal may not toggle and may have a constant level in the power saving period in which the repeated data pattern is transferred and in the horizontal blank period. Thus, the data driver 130 may not sample the image data in the power saving period in which the repeated data pattern is transferred and in the horizontal blank period (S390). Accordingly, power consumption of a display device may be reduced.

Figure 6:
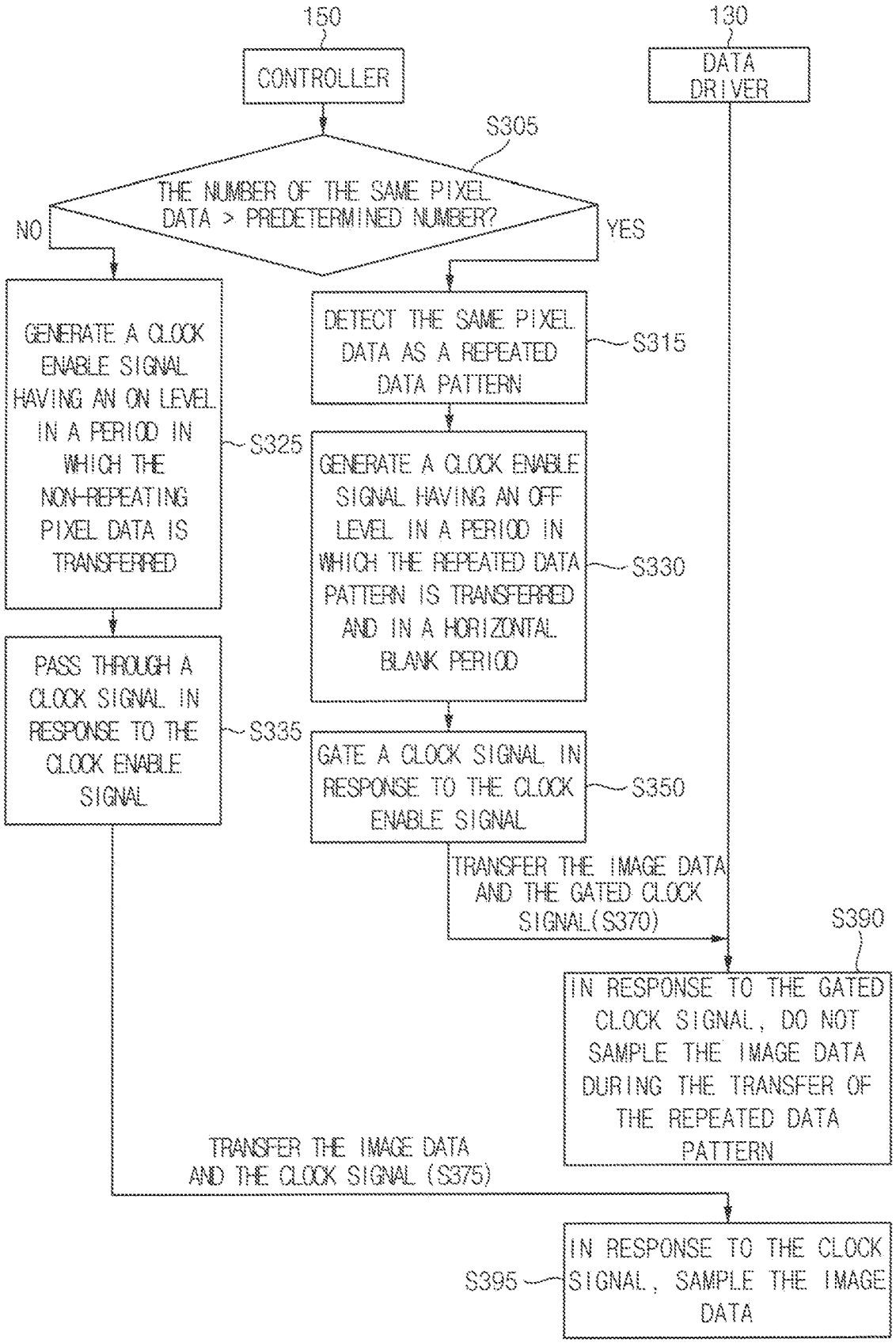
FIG. 6 is a flow chart that illustrates a method of transferring data between a controller and a data driver according to embodiments.

FIG. 6 is a flow chart that illustrates a method of transferring data between a controller and a data driver according to embodiments.

Referring to FIG. 6, a controller 150 may detect the same pixel data consecutively repeated more than a predetermined number of times as a repeated data pattern in image data (S305 and S315). For example, if the same pixel data is consecutively repeated less than or equal to the predetermined number of times (S305: NO), the controller 150 may determine that the same pixel data is not the repeated data pattern. However, if the same pixel data is consecutively repeated more than the predetermined number of times (S305: YES), the controller 150 may detect the same pixel data consecutively repeated more than the predetermined number of times as the repeated data pattern (S315). For example, the predetermined number may be, but not limited to, about fifty.

The controller 150 may generate a clock enable signal with an off level in a power saving period in which the repeated data pattern is transferred and in a horizontal blank period (S330) or may generate a clock enable signal with an on level if the repeated data pattern is not detected (e.g., in a period in which non-repeating pixel data is transferred) (S325). The controller 150 may generate a gated clock signal by gating a clock signal in response to the clock enable signal with the off level (S350), or may pass through a clock signal in response to the clock enable signal with the on level (S335). The controller 150 may transfer the image data and the gated clock signal to the data driver 130 (S370 and S375).

The data driver 130 may sample the image data in response to the clock signal that periodically toggles (S395). Alternatively, the data driver 130 may not sample the image data in the power saving period in which the repeated data pattern is transferred and in the horizontal blank period in response to the gated clock signal (S390). Accordingly, power consumption of a display device may be reduced.

Figure 7:
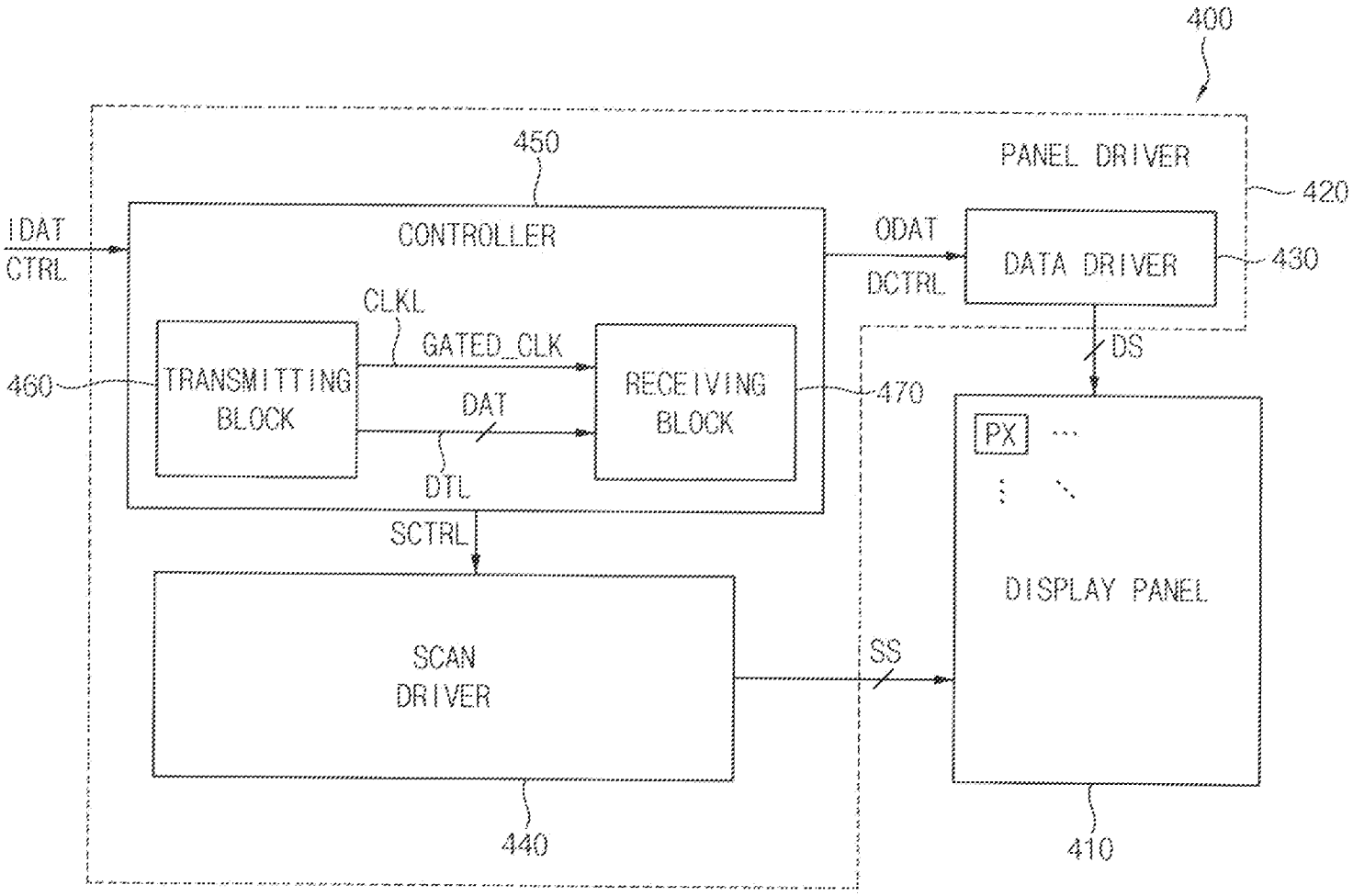
FIG. 7 is a block diagram that illustrates a display device according to embodiments.
Figure 8:
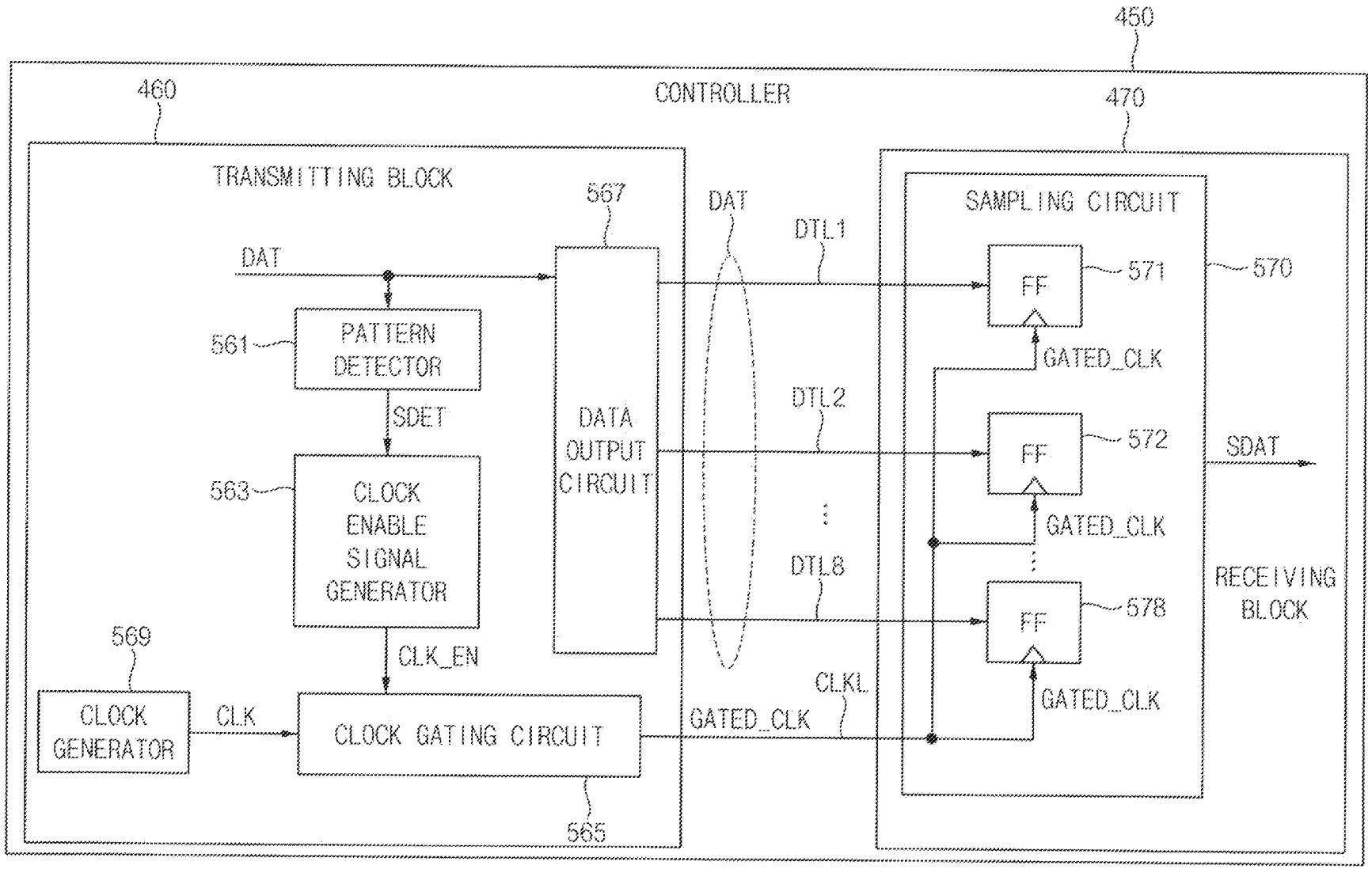
FIG. 8 is a block diagram that illustrates an example of a controller included in a display device according to embodiments.

FIG. 7 is a block diagram that illustrates a display device according to embodiments, and FIG. 8 is a block diagram that illustrates an example of a controller included in a display device according to embodiments.

Referring to FIG. 7, a display device 400 according to embodiments may include a display panel 410 and a panel driver 420. In some embodiments, the panel driver 420 may include a data driver 430, a scan driver 440 and a controller 450. The controller 450 may include a transmitting block 460 and a receiving block 470. The display device 400 of FIG. 7 may have a similar configuration and a similar operation to a display device 100 of FIG. 1, except in that a data transfer method according to embodiments is performed between the transmitting block 460 of the controller 450 and the receiving block 470 of the controller 450.

The controller 450 may generate output image data ODAT and a data control signal DCTRL based on input image data DAT and a control signal CTRL, and may control an operation of the data driver 430 by providing the output image data ODAT and the data control signal DCTRL to the data driver 430.

The transmitting block 460 of the controller 450 may output image data DAT including a plurality of pixel data for a plurality of pixels PX of the display panel 410 through a plurality of data transfer lines DTL, and may output a gated clock signal GATED_CLK through a clock signal line CLKL. The receiving block 470 of the controller 450 may receive the image data DAT from the transmitting block 460 through the plurality of data transfer lines DTL, and may receive the gated clock signal GATED_CLK from the transmitting block 460 through the clock signal line CLKL. The receiving block 470 may sample the image data DAT in response to the gated clock signal GATED_CLK. The transmitting block 460 and the receiving block 470 may be any blocks or intellectual properties (IPs) within the controller 450. In some embodiments, the transmitting block 460 may be, but not limited to, an interface block that receives the input image data IDAT from an external host processor, and the receiving block 470 may be, but not limited to, a data processing block that performs a data compensation operation on the image data DAT. In some embodiments, the transmitting block 460 and the receiving block 570 may be implemented together on a single integrated circuit, or they may be implemented separately on different circuits.

In the display device 400 according to embodiments, the transmitting block 460 may detect a repeated data pattern where the same pixel data is repeated in the image data DAT, may generate a clock enable signal having an off level (e.g., a low level) in a power saving period in which the repeated data pattern is transferred, and may generate the gated clock signal GATED_CLK by gating a clock signal in response to the clock enable signal. In some embodiments, the gated clock signal GATED_CLK generated by the transmitting block 460 may periodically toggle in a horizontal active period except for the power saving period in which the repeated data pattern is transferred, and may have a constant level in the power saving period in which the repeated data pattern is transferred and in a horizontal blank period. The receiving block 470 may sample the image data DAT in response to the gated clock signal GATED_CLK that periodically toggles, and may not sample the image data DAT in response to the gated clock signal GATED_CLK that has the constant level.

To perform these operations, as illustrated in FIG. 8, the transmitting block 460 of the controller 450 may include a pattern detector 561, a clock enable signal generator 563 and a clock gating circuit 565, and the receiving block 470 of the controller 450 may include a sampling circuit 570. In some embodiments, the transmitting block 460 may further include a data output circuit 567 and/or a clock generator 569.

The pattern detector 561 may detect the repeated data pattern in the image data DAT. The clock enable signal generator 563 may generate the clock enable signal CLK_EN with the off level (e.g., the low level) in the power saving period in which the repeated data pattern is transferred within the horizontal active period and in the horizontal blank period. The clock gating circuit 565 may generate the gated clock signal GATED_CLK by gating the clock signal CLK in response to the clock enable signal CLK_EN. A plurality of bits of each pixel data of the image data DAT may be substantially simultaneously transferred through the plurality of data transfer lines DTL1 through DTL8, and the gated clock signal GATED_CLK may be transferred through the clock signal line CLKL. A plurality of flip-flops 571, 572, . . . , 578 of the sampling circuit 570 may substantially simultaneously sample the plurality of bits of each pixel data transferred through the plurality of data transfer lines DTL1 through DTL8 in response to the gated clock signal GATED_CLK. During the power saving period in which the repeated data pattern is transferred and the horizontal blank period, the gated clock signal GATED_CLK may have the constant level (e.g., a low level), the plurality of data transfer lines DTL1 through DTL8 may have constant levels, and the sampling circuit 570 may not perform a sampling operation based on the gated clock signal GATED_CLK with the constant level. Accordingly, power consumption of the display device 400 may be reduced.

Figure 9:
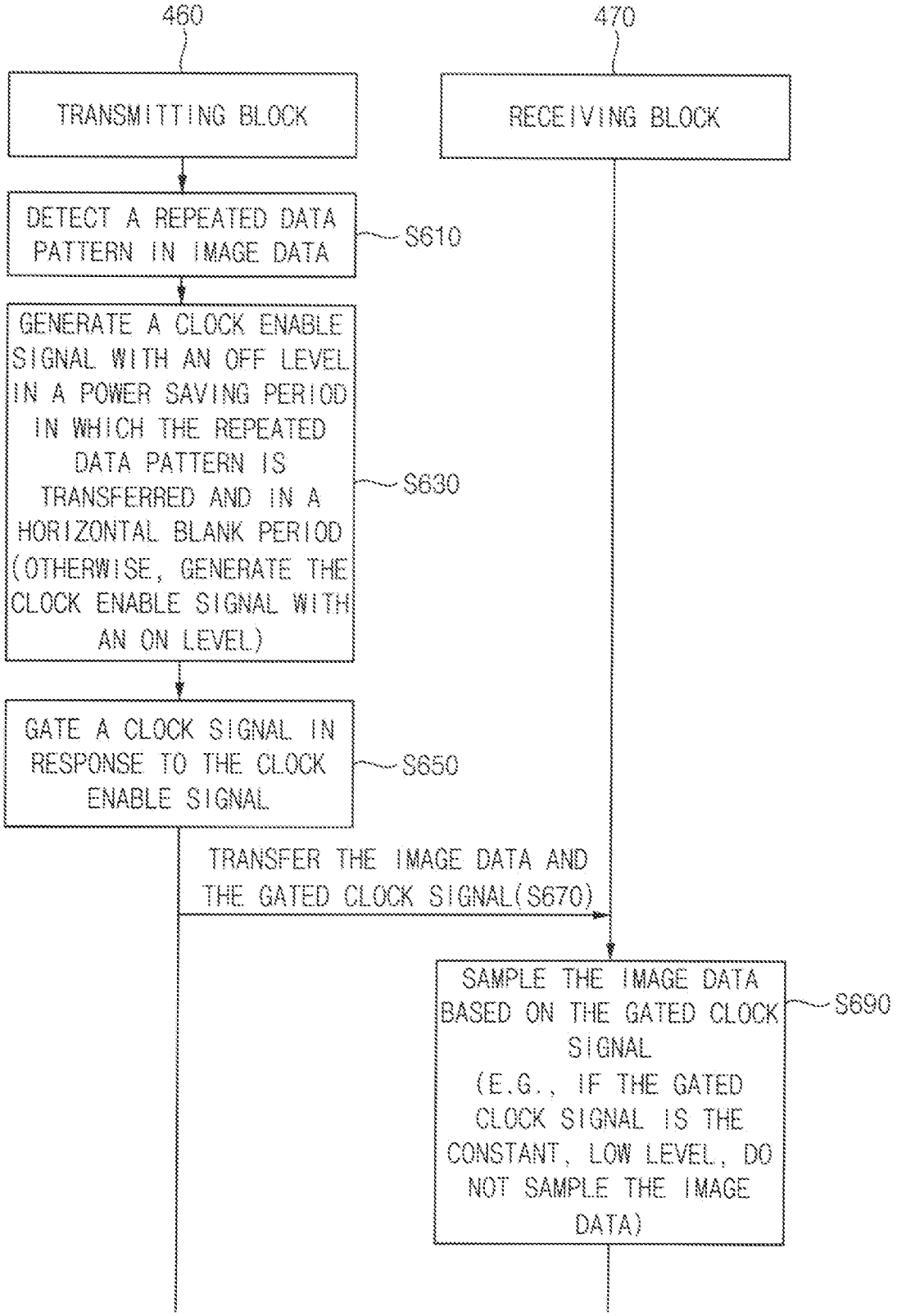
FIG. 9 is a flow chart that illustrates a method of transferring data between a transmitting block and a receiving block according to embodiments.

FIG. 9 is a flow chart that illustrates a method of transferring data between a transmitting block and a receiving block according to embodiments.

Referring to FIG. 9, a transmitting block 460 of a controller may detect a repeated data pattern where the same pixel data is repeated in image data (S610), may generate a clock enable signal in a power saving period in which the repeated data pattern is transferred and in a horizontal blank period (or may generate a clock enable signal with an on level if the repeated data pattern is not detected) (S630), may generate a gated clock signal by gating a clock signal in response to the clock enable signal (S650), and may transfer the image data and the gated clock signal to a receiving block 470 of the controller (S670).

The receiving block 470 may sample the image data in response to the gated clock signal (S690). The gated clock signal may not toggle and may have a constant level in the power saving period in which the repeated data pattern is transferred and in the horizontal blank period. Thus, the receiving block 470 may not sample the image data in the power saving period in which the repeated data pattern is transferred and in the horizontal blank period (S690). Accordingly, power consumption of a display device may be reduced.

Figure 10:
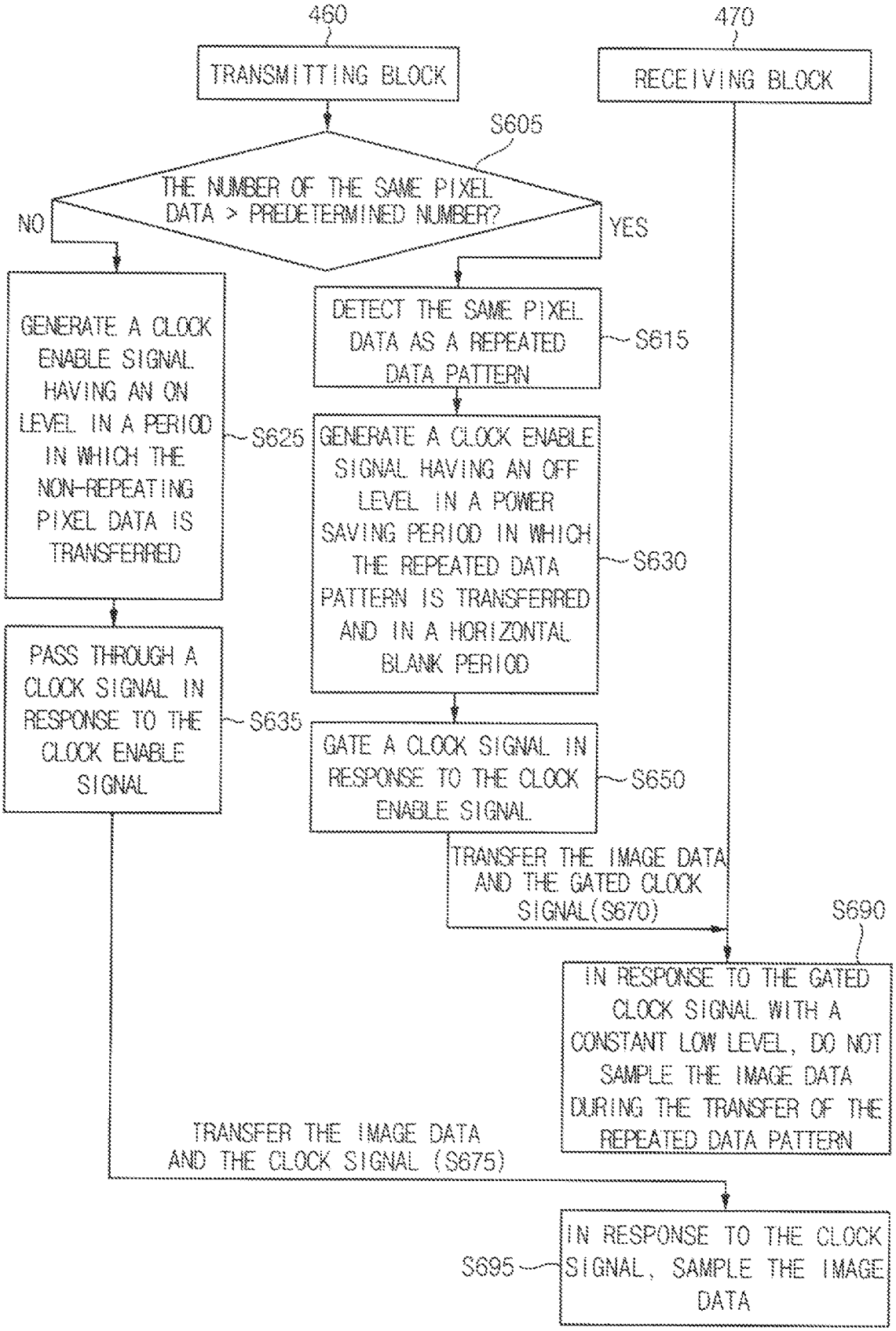
FIG. 10 is a flow chart that illustrates a method of transferring data between a transmitting block and a receiving block according to embodiments.

FIG. 10 is a flow chart that illustrates a method of transferring data between a transmitting block and a receiving block according to embodiments.

Referring to FIG. 10, a transmitting block 460 of a controller may detect the same pixel data consecutively repeated more than a predetermined number of times as a repeated data pattern in image data (S605 and S615). That is, if the same pixel data is consecutively repeated less than or equal to the predetermined number of times (S605: NO), the transmitting block 460 may determine that the same pixel data is not the repeated data pattern. However, if the same pixel data is consecutively repeated more than the predetermined number of times (S605: YES), the transmitting block 460 may detect the same pixel data consecutively repeated more than the predetermined number of times as the repeated data pattern (S615).

The transmitting block 460 may generate a clock enable signal in a power saving period in which the repeated data pattern is transferred and in a horizontal blank period (S630) or may generate a clock enable signal with an on level if the repeated data pattern is not detected (e.g., in a period in which non-repeating pixel data is transferred) (S625). The transmitting block 460 may generate a gated clock signal by gating a clock signal in response to the clock enable signal with the off level (S650), or may pass through a clock signal in response to the clock enable signal with the on level (S635). The transmitting block 460 may transfer the image data and the gated clock signal to a receiving block 470 of the controller (S670 and S675).

The receiving block 470 may sample the image data in response to the clock signal that periodically toggles (S695). The receiving block 470 may not sample the image data in the period in which the repeated data pattern is transferred (the "power saving period") and in the horizontal blank period in response to the gated clock signal. Accordingly, power consumption of a display device may be reduced.

Figure 11:
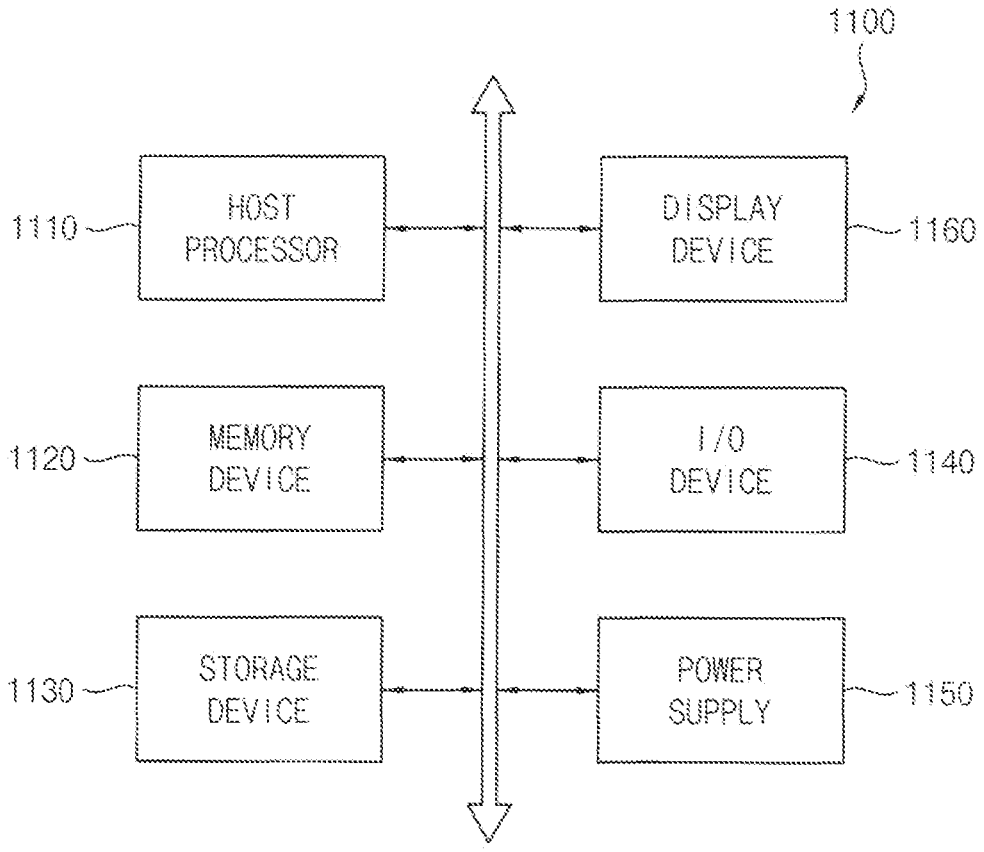
FIG. 11 is a block diagram that illustrates an electronic device including a display device according to embodiments.

FIG. 11 is a block diagram that illustrates an electronic device including a display device according to embodiments.

Referring to FIG. 11, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, and/or other electric devices, etc.

The processor 1110 may perform various computing functions or tasks. The processor 1110 may include an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may include a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may include a display panel including a plurality of pixels, and a panel driver configured to drive the display panel. The panel driver may include a transmitting unit that outputs image data including a plurality of pixel data for the plurality of pixels and a gated clock signal. The panel driver may further include a receiving unit that receives the image data and the gated clock signal from the transmitting unit, and samples the image data in response to the gated clock signal. In some embodiments, the transmitting unit may be a controller, and the receiving unit may be a data driver. In other embodiments, the transmitting unit may be a transmitting block included in the controller, and the receiving unit may be a receiving block included in the controller. The transmitting unit may detect a repeated data pattern where same pixel data is repeated in the image data, may generate a clock enable signal with an off level (e.g., a low level) in a power saving period in which the repeated data pattern is transferred, and may generate the gated clock signal by gating a clock signal in response to the clock enable signal. The receiving unit may not sample the image data in response to the gated clock signal having a constant level in the power saving period in which the repeated data pattern is transferred. Accordingly, power consumption of the display device 1160 may be reduced.

The inventive concepts provided herein may be applied any electronic device 1100 including the display device 1160. For example, the inventive concepts may be applied to a television (TV), a digital TV, a 3D TV, a mobile phone, a smart phone, a tablet computer, a virtual reality (VR) device, a wearable electronic device, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that modifications to the disclosed embodiments, as well as other embodiments, are intended to be included within the scope of the appended claims.

What is claimed is:

1. A display device comprising:

a display panel including a plurality of pixels;

a controller configured to output image data and a gated clock signal, the image data including a plurality of pixel data for the plurality of pixels; and a data driver configured to receive the image data and the gated clock signal from the controller, and to sample the image data in response to the gated clock signal, wherein the controller is further configured to:

detect a repeated data pattern where same pixel data is repeated in the image data;

generate a clock enable signal, wherein the clock enable signal is generated with an off level during a power saving period in which the repeated data pattern is transferred; and gate an input clock signal in response to the clock enable signal to produce the gated clock signal.

2. The display device of claim 1, wherein the data driver does not sample the image data during the power saving period.

3. The display device of claim 2, wherein the gated clock signal has a constant off level during the power saving period and during a horizontal blank period.

4. The display device of claim 3, wherein the data driver samples the image data during periods when the gated clock signal periodically toggles, and does not sample the image data during periods when the gated clock signal has the constant off level.

5. The display device of claim 1, wherein the controller includes:

a pattern detector configured to detect the repeated data pattern in the image data;

a clock enable signal generator configured to generate the clock enable signal having the off level during the power saving period and during a horizontal blank period; and a clock gating circuit configured to gate the input clock signal in response to the clock enable signal to produce the gated clock signal.

6. The display device of claim 1, wherein the data driver includes:

a sampling circuit configured not to sample the image data in response to the gated clock signal having a constant level during the power saving period and during a horizontal blank period, and to sample the image data in response to the gated clock signal periodically toggling between a high value and a low value during other periods.

7. The display device of claim 1, further comprising:

a clock signal line through which the gated clock signal is transferred from the controller to the data driver; and a plurality of data transfer lines through which the image data is transferred from the controller to the data driver.

8. The display device of claim 7, wherein a plurality of bits of each pixel data of the image data are substantially simultaneously transferred through the plurality of data transfer lines.

9. The display device of claim 7, wherein each of the plurality of data transfer lines has constant levels corresponding to the same pixel data in the power saving period.

10. The display device of claim 1, wherein, when the same pixel data is repeated more than a predetermined number of times in the image data, the controller detects the same pixel data repeated more than the predetermined number of times as the repeated data pattern.

11. A display device comprising:

a display panel including a plurality of pixels;

a data driver configured to provide data signals to the plurality of pixels;

a scan driver configured to provide scan signals to the plurality of pixels; and a controller configured to control the data driver and the scan driver, the controller including:

a transmitting block configured to output image data and a gated clock signal, the image data including a plurality of pixel data for the plurality of pixels; and a receiving block configured to receive the image data and the gated clock signal from the transmitting block, and to sample the image data in response to the gated clock signal, wherein the transmitting block is further configured to:

detect a repeated data pattern where more than two pixel data is repeated in the image data;

generate a clock enable signal having an off level during a power saving period in which the repeated data pattern is transferred; and gate an input clock signal in response to the clock enable signal having the off level to disable sampling of pixel data during the power saving period.

12. The display device of claim 11, wherein the gated clock signal has a constant level during the power saving period and during a horizontal blank period, and wherein the gated clock signal periodically toggles between a high value and a low value during other periods.

13. The display device of claim 12, wherein the receiving block samples the image data in response to when the gated clock signal periodically toggles, and does not sample the image data in response to when the gated clock signal has the constant level.

14. The display device of claim 11, wherein the transmitting block includes:

a pattern detector configured to detect the repeated data pattern in the image data;

a clock enable signal generator configured to generate the clock enable signal with the off level during the power saving period and during a horizontal blank period; and a clock gating circuit configured to gate the input clock signal in response to the clock enable signal to produce the gated clock signal.

15. The display device of claim 11, wherein the controller further includes:

a clock signal line through which the gated clock signal is transferred from the transmitting block to the receiving block; and a plurality of data transfer lines through which the image data is transferred from the transmitting block to the receiving block.

16. The display device of claim 15, wherein a plurality of bits of each pixel data of the image data are substantially simultaneously transferred through the plurality of data transfer lines.

17. The display device of claim 15, wherein each of the plurality of data transfer lines has constant levels corresponding to the same pixel data in the power saving period in which the repeated data pattern is transferred.

18. A display device comprising:

a display panel including a plurality of pixels; and a panel driver configured to drive the display panel, the panel driver including:

a transmitting unit configured to output image data and a gated clock signal, the image data including a plurality of pixel data for the plurality of pixels; and a receiving unit configured to receive the image data and the gated clock signal from the transmitting unit, and to sample the image data in response to the gated clock signal, wherein the transmitting unit is further configured to:

detect a repeated data pattern where same pixel data is repeated in the image data;

generate a clock enable signal having an off level during a power saving period in which the repeated data pattern is transferred; and gate an input clock signal in response to the clock enable signal to produce the gated clock signal.

19. The display device of claim 18, wherein the panel driver includes a data driver, a scan driver and a controller, wherein the transmitting unit is the controller, and wherein the receiving unit is the data driver.

20. The display device of claim 18, wherein the panel driver includes a data driver, a scan driver and a controller, wherein the transmitting unit comprises a transmitting block included in the controller, and wherein the receiving unit comprises a receiving block included in the controller.

* * * * *